United States Patent [19]

Tateishi

[11] Patent Number: 4,464,208

[45] Date of Patent: Aug. 7, 1984

[54] AMORPHOUS ALLOY FOR MAGNETIC HEAD

[75] Inventor: Hiroshi Tateishi, Zushi, Japan

[73] Assignee: Tokyo Shibaura Denki Kabushiki Kaisha, Kawasaki, Japan

[21] Appl. No.: 454,545

[22] Filed: Dec. 30, 1982

[30] Foreign Application Priority Data

Jan. 8, 1982 [JP] Japan ..... 54-1542

[51] Int. Cl.[3] ..... H01F 1/04

[52] U.S. Cl. ..... 148/31.55; 148/403; 148/425; 420/435; 420/440; 420/581; 420/583

[58] Field of Search ..... 148/31.55, 403, 425; 420/435, 581, 440, 583; 75/123 R, 123 B, 123 L

[56] References Cited

U.S. PATENT DOCUMENTS 3,856,513 12/1974 Chen et al. ..... 75/122
4,190,438 2/1980 Aso et al. ..... 75/123 B
4,236,946 12/1980 Aboaf et al. ..... 148/108

FOREIGN PATENT DOCUMENTS 48888 4/1982 European Pat. Off. ..... 148/403

OTHER PUBLICATIONS

Chemical Abstracts, vol. 95, 1981, p. 293, No. 173872a.
Chemical Abstracts, vol. 98, 1983, p. 271, No. 58601m.

*Primary Examiner*—John P. Sheehan
*Attorney, Agent, or Firm*—Schwartz, Jeffery, Schwaab, Mack, Blumenthal & Koch

[57] ABSTRACT

Disclosed is an amorphous alloy for a magnetic head, which is of the formula:

$$(Co_{1-a-b-c}Fe_aRu_bTM_c)_{100-x-y}Si_xB_y$$

wherein TM is at least one of Ti, V, Cr, Mn, Ni, Zr, Nb, Mo, Hf, Ta and W, and, in atomic concentrations, $0.02 \leqq a \leqq 0.08$, $0.07 \leqq b \leqq 0.2$, $c=0$ or $0.01 \leqq c \leqq 0.1$, $0 \leqq x \leqq 20$ and $4 \leqq y \leqq 9$, which is excellent in abrasion-resistance and simultaneously has high permeability.

14 Claims, 1 Drawing Figure

Effective permeability
$10^5$
$10^4$
$10^3$
$10^2$
t=20μm
t=14μm
t=30μm
(Co 0.83 Fe 0.05 Ti 0.02 Ru 0.10) 79 Si 13 B 8
10K
100K
1M
10M
Frequency (Hz)

AMORPHOUS ALLOY FOR MAGNETIC HEAD

BACKGROUND OF THE INVENTION

This invention relates to an amorphous alloy which is suitable for use in a magnetic head and is of improved abrasion-resistance.

Heretofore, as a material of high permeability and suited for use in a magnetic head, there have been known a Fe-Ni alloy (Permalloy), a Fe-Si-Al alloy (Sendust) and the like which are crystalline. However, the Fe-Ni alloy is high in permeability on the one hand and poor in abrasion-resistance on the other hand; the Fe-Si-Al alloy is excellent in abrasion-resistance, but is too brittle to be plastically workable.

Taking the place of these alloys, an amorphous alloy, which is non-crystalline, has been found to have excellent mechanical and magnetic properties when used as the material for a magnetic head, and it has recently been acknowledged as a new material. However, despite its high Vickers hardness which in general reaches a value as large as 1000, it has been known, and has been a serious problem in practice, that the material is seriously worn by friction with a tape when it is used for a magnetic head.

The mechanism of abrasion of a magnetic head where such an amorphous alloy is used therefor has ever been discussed from a variety of viewpoints, and it has been considered that the abrasion is caused principally by mechanical factors and chemical factors. As a result of studies, however, no relationship is observed between Vickers hardness of the amorphous alloy and the quantity or degree of abrasion (i.e. abrasion-resistance) thereof, and it is considered that the abrasion is more greatly influenced by the chemical factors. For this reason, the advent of the amorphous alloy having higher abrasion-resistance to the wear of head caused by the chemical factors, has long been desired.

SUMMARY OF THE INVENTION

In view of the foregoing, it is an object of this invention to provide an amorphous alloy for a magnetic head, which is excellent in abrasion-resistance and simultaneously has high permeability.

DETAILED DESCRIPTION OF THE PREFERRED EMBODIMENTS

Figure 1:
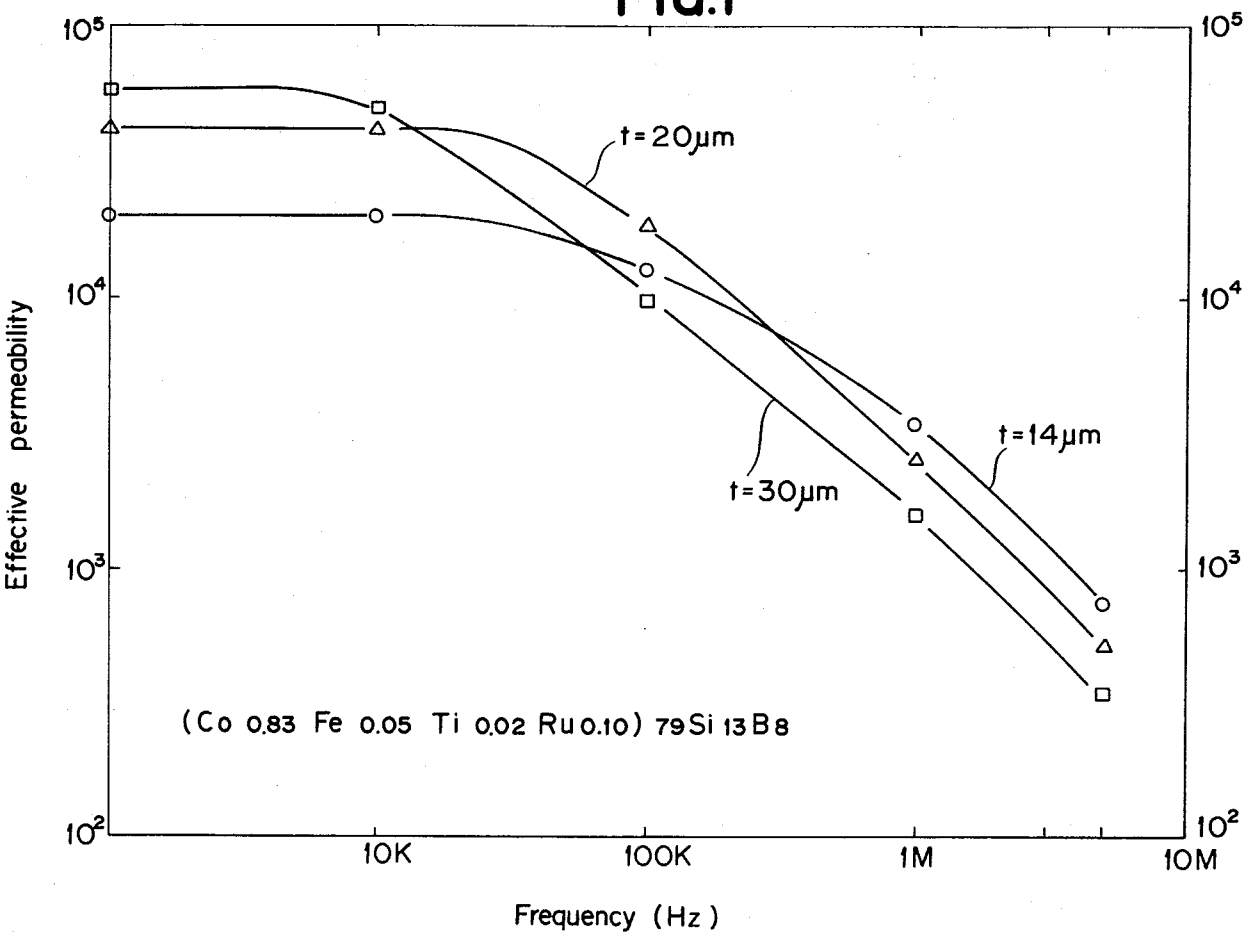
FIG. 1 is a graph showing the permeability versus frequency characteristics of three thicknesses of material made according to Example 3.

According to this invention, there is provided an amorphous alloy for a magnetic head, which alloy is of a cobalt(Co)-system of the formula:

$$(Co_{1-a-b-c}Fe_aRu_bTM_c)_{100-x-y}Si_xB_y$$

wherein TM is at least one selected from the group consisting of titanium(Ti), vanadium(V), chromium(Cr), manganese(Mn), nickel(Ni), zirconium(Zr), niobium(Nb), molybdenum(Mo), hafnium(Hf), tantalum(Ta) and tungsten (W), "a", "b", "c", "x" and "y" are atomic concentrations (or compositional proportions) ranging from 0.02 to 0.08, 0.07 to 0.2, 0 or 0.01 to 0.1, 0 to 20, and 4 to 9, respectively (i.e. $0.02 \leqq a \leqq 0.08$, $0.07 \leqq b \leqq 0.2$, $c=0$ or $0.01 \leqq c \leqq 0.1$, $0 \leqq x \leqq 20$, $4 \leqq y \leqq 9$).

Functions, compositional proportions, and reasons for defining the proportion, of the elements to be added to the Co-system alloy of the invention will be described below:

In this invention, iron(Fe) functions as a component for improving permeability. It functions most effectively when its compositional proportion "a" is in the range of 0.02 to 0.08; if it is out of this range, the permeability will become inferior.

Ruthenium(Ru) has remarkable effect in respect of improvement in abrasion-resistance of the alloy according to the invention, and it is preferred that its compositional proportion "b" is in the range of 0.07 to 0.2, i.e. $0.07 \leqq b \leqq 0.2$. If the "b" is less than 0.07, the improvement in abrasion-resistance will become less effective; if it exceeds 0.2, saturated magnetic flux density will become lower than 2500 G. Thus, the proportion is set to be in the range as defined above. Ru is an element belonging to platinum group metals to which platinum(Pt), paradium(Pd), rhodium(Rh), etc. also belong. However, Pt and Pd are not suitable for this invention since they are hard to come into the amorphous state; as for the Rh, it is inadequate, though effective to some extent, for improvement of abrasion-resistance. It is possible in this invention to obtain a remarkable effect in improvement of significant abrasion-resistance by selecting, of the platinum group metals, the Ru and adding it in a given amount.

Silicon(Si), and boron(B) as well, function most effectively as an accelerator for making the alloy amorphous, and it is preferred that its compositional proportion "x" is in the range of 0 to 20, i.e. $0 \leqq x \leqq 20$. Here it is possible to obtain the alloy of the invention in the amorphous state even if it contains no Si ($x=0$), provided that B is added. It is not preferred that "x" exceeds 20, since the saturated magnetic flux density will then become lower than 7500 G.

Boron acts as a component not only for acceralating the formation of the alloy in the amorphous state but also for improving the abrasion-resistance, and its compositional proportion "y" is preferably in the range of 4 to 9 ($4 \leqq y \leqq 9$). Here, if "y" is less than 4, it becomes difficult to produce an amorphous alloy, and in addition, it becomes impossible to obtain an alloy of high permeability; if it exceeds 9, abrasion-resistance of the alloy will become inferior. Thus the proportion is set to be in the range as defined above.

TM is a component which may not be contained in the alloy according to an embodiment of this invention. In another embodiment of the invention, this component is preferably contained in the alloy to obtain the products of more improved properties.

TM represents at least one of Ti, V, Cr, Mn, Ni, Zr, Nb, Mo, Hf, Ta and W, which are elements useful for improvement of properties of the alloy of the invention; it is useful for improving remarkably the abrasion-resistance, increasing the permeability, decreasing the coercive force and enhancing the thermal stability. Its compositional proportion "c" should preferably be in the range of 0.01 to 0.1 ($0.01 \leqq c \leqq 0.1$). If it is less than 0.01, less effect will be obtainable by the addition thereof; if it exceeds 0.1, it will follow not only that the permeability is lowered but also that effect in improvement of the abrasion-resistance is saturated. Thus, its proportion is set to be in the range as defined above.

This invention will be described further in detail by the following Examples and Comparative Examples:

EXAMPLE 1

Using a fluid rapid-quenching method in which a molten alloy is squirted, under argon gas pressure, out of a nozzle of a quartz pipe onto the surface of a single roller rotating at a high speed and then is quenched rapidly, thin ribbon samples of the amorphous alloys were prepared, each being 12 mm in width, 20 μm in thickness and 10 m in length. The composition of the alloy of each of the samples is shown in Table 1 for Sample Nos. 1 to 6.

The thin ribbon samples thus prepared were punched into rings of 10 mm ϕ in outer diameter and 8 mm ϕ in inner diameter, 10 pieces of which were laminated with layer-insulating materials interposed between the rings and were subjected to heat treatment for 10 minutes at a temperature higher than the Curie temperature and lower than the crystalization temperature. Thereafter, primary coils and secondary coils were provided to the 10 pieces of the rings thus laminated and treated, in order to measure the permeability and the DC magnetization curve of the respective products.

The permeability was measured by using respectively a Maxwell bridge in respect of the frequency up to 100 KHz and a radio-frequency bridge in respect of the MHz band area. The DC magnetization curve was measured by using an automatic recording fluxmeter. Further, some of the thin ribbon samples of the respective amorphous alloys were punched into a form of an audio magnetic head core to produce magnetic heads for testing, of which the abrasion-resistance was evaluated. Measurement of the quantity (or rate) of abrasion was performed by using TALYSTEP, a surface roughness tester, to measure changes of the state of tape-sliding surfaces of the magnetic heads before and after 1,000 hours of driving an audio cassette tape on which $\gamma$-$Fe_2O_3$ was coated. The quantity (or rate) of the changes were determined by converting them to microns per 100 hours of driving.

Vickers hardness was further measured by using a microvichers hardness tester.

The characteristics thus obtained, such as effective permeability at 1 KHz (μ'1K), coercive force, saturated magnetization, quantity or degree of abrasion, and Vickers hardness, of the respective samples are shown together in Table 1.

COMPARATIVE EXAMPLE 1

Following the procedures in Example 1, samples of amorphous alloys were prepared having a composition as shown in Table 1; namely, a sample (No. 7) containing as a component of the amorphous alloy Ru in a smaller amount than the range as defined in this invention, a sample (No. 8) containing Ru in a larger amount than the range as defined in this invention, a sample (No. 9) to which added was Rh in place of Ru, and samples (Nos. 10 and 11) containing no Ru at all.

The characteristics were also examined in respect of these samples, in the same manner as in Example 1. The results are shown together in Table 1.

TABLE 1

| Sample No. | | Composition | Effective permi-ability (μ'1K) | Coercive force (Oe) | Saturation magnetic flux density (G) | Quantity of abrasion (μm/100 hr) | Vickers hardness (Kg/mm²) |
|---|---|---|---|---|---|---|---|
| Example 1 | No. 1 | $(Co_{0.84}Fe_{0.06}Ru_{0.10})_{76}Si_{16}B_8$ | 38000 | 0.012 | 8400 | 0.050 | 870 |
| | No. 2 | $(Co_{0.80}Fe_{0.05}Ru_{0.15})_{77}Si_{15}B_8$ | 40000 | 0.011 | 8100 | 0.040 | 880 |
| | No. 3 | $(Co_{0.76}Fe_{0.04}Ru_{0.20})_{78}Si_{14}B_8$ | 42000 | 0.011 | 7800 | 0.035 | 880 |
| | No. 4 | $(Co_{0.865}Fe_{0.06}Ru_{0.075})_{75}Si_{17}B_8$ | 38000 | 0.012 | 8500 | 0.070 | 870 |
| | No. 5 | $(Co_{0.865}Fe_{0.06}Ru_{0.075})_{77}Si_{17}B_6$ | 38000 | 0.012 | 8900 | 0.060 | 880 |
| | No. 6 | $(Co_{0.84}Fe_{0.06}Ru_{0.10})_{78}Si_{16}B_6$ | 39000 | 0.011 | 8500 | 0.045 | 880 |
| Comparative Example 1 | No. 7 | $(Co_{0.89}Fe_{0.06}Ru_{0.05})_{75}Si_{17}B_8$ | 37000 | 0.012 | 8700 | 0.150 | 870 |
| | No. 8 | $(Co_{0.66}Fe_{0.04}Ru_{0.30})_{75}Si_{17}B_8$ | 30000 | 0.013 | 5000 | 0.035 | 890 |
| | No. 9 | $(Co_{0.80}Fe_{0.05}Rh_{0.15})_{77}Si_{15}B_8$ | 34000 | 0.014 | 8000 | 0.170 | 800 |
| | No. 10 | $(Co_{0.90}Fe_{0.06}Cr_{0.04})_{80}Si_{10}B_{10}$ | 47000 | 0.010 | 8500 | 4.0 | 900 |
| | No. 11 | $(Co_{0.94}Fe_{0.06})_{75}Si_{10}B_{15}$ | 10000 | 0.025 | 8000 | 7.0 | 870 |

As is apparent from the results shown in the above table, the abrasion-resistance of the amorphous alloy according to this invention has been remarkably improved by virtue of the addition of Ru. It has been also confirmed that the amorphous alloys according to this invention are excellent in magnetic properties. On the other hand, the amorphous alloys incorporated with Rh show insufficient effects in improvement of the abrasion-resistance.

EXAMPLE 2

Following the procedures in Example 1, samples of amorphous alloys were prepared having a alloy composition as shown by Nos. 1 to 17 in Table 2, and effective permeability, coercive force, saturation magnetic flux density, quantity or degree of abrasion, and Vickers hardness, respectively, of the samples were measured. The results are shown in Table 2.

COMPARATIVE EXAMPLE 2

Following the procedures in Example 1, samples of amorphous alloys were prepared having a composition as shown in Table 2; namely, a sample (No. 18) containing as a component of the amorphous alloy TM in a larger amount than the range as defined in this invention, a sample (No. 19) containing Ru in a smaller amount than the range as defined in this invention, and a sample (No. 20) containing neither TM nor Ru.

The characteristics were also examined in respect of these samples, in the same manner as in Example 1. The results are shown together in Table 2.

TABLE 2

| Sample No. | | Composition | | | | Effective permi-ability (μ'1K) | Coercive force (Oe) | Satura-tion magnetic flux density (G) | Quantity of abrasion (μm/100 hr) | Vickers hard-ness (Kg/mm²) |
|---|---|---|---|---|---|---|---|---|---|---|
| Example 2 | No. 1 | (Co0.83 | Fe0.05 | Ti0.02 Ru0.10)$_{79}$ | $Si_{13}B_8$ | 43000 | 0.008 | 8300 | 0.035 | 900 |
| | No. 2 | (Co0.785 | Fe0.045 | Ti0.02 Ru0.15)$_{80}$ | $Si_{12}B_8$ | 45000 | 0.008 | 8100 | 0.030 | 900 |
| | No. 3 | (Co0.74 | Fe0.04 | Ti0.02 Ru0.20)$_{82}$ | $Si_{10}B_8$ | 47000 | 0.008 | 8100 | 0.025 | 900 |
| | No. 4 | (Co0.83 | Fe0.05 | V 0.02 Ru0.10)$_{79}$ | $Si_{13}B_8$ | 47000 | 0.008 | 8300 | 0.040 | 880 |
| | No. 5 | (Co0.83 | Fe0.05 | Cr0.02 Ru0.10)$_{79}$ | $Si_{13}B_8$ | 55000 | 0.007 | 8100 | 0.035 | 860 |
| | No. 6 | (Co0.83 | Fe0.05 | Mn0.02 Ru0.10)$_{79}$ | $Si_{13}B_8$ | 50000 | 0.009 | 8600 | 0.045 | 870 |
| | No. 7 | (Co0.83 | Fe0.05 | Ni0.02 Ru0.10)$_{79}$ | $Si_{13}B_8$ | 48000 | 0.010 | 8300 | 0.045 | 840 |
| | No. 8 | (Co0.83 | Fe0.05 | Zr0.02 Ru0.10)$_{79}$ | $Si_{13}B_8$ | 46000 | 0.011 | 8300 | 0.035 | 890 |
| | No. 9 | (Co0.83 | Fe0.05 | Nb0.02 Ru0.10)$_{79}$ | $Si_{13}B_8$ | 46000 | 0.011 | 8000 | 0.040 | 900 |
| | No. 10 | (Co0.83 | Fe0.05 | Mo0.02 Ru0.10)$_{80}$ | $Si_{12}B_8$ | 46000 | 0.011 | 8000 | 0.040 | 890 |
| | No. 11 | (Co0.83 | Fe0.05 | Hf0.02 Ru0.10)$_{80}$ | $Si_{12}B_8$ | 46000 | 0.011 | 7900 | 0.040 | 890 |
| | No. 12 | (Co0.83 | Fe0.05 | Ta0.02 Ru0.10)$_{79}$ | $Si_{13}B_8$ | 46000 | 0.012 | 8000 | 0.035 | 890 |
| | No. 13 | (Co0.83 | Fe0.05 | W 0.02 Ru0.10)$_{80}$ | $Si_{12}B_8$ | 46000 | 0.011 | 8000 | 0.035 | 900 |
| | No. 14 | (Co0.77 | Fe0.04 | Ti0.09 Ru0.10)$_{82}$ | $Si_{10}B_8$ | 38000 | 0.013 | 8000 | 0.022 | 950 |
| | No. 15. | (Co0.855 | Fe0.05 | Ti0.02 Ru0.075)$_{78}$ | $Si_{14}B_8$ | 43000 | 0.008 | 8400 | 0.050 | 890 |
| | No. 16 | (Co0.855 | Fe0.05 | Ti0.02 Ru0.075)$_{78}$ | $Si_{10}B_6$ | 43000 | 0.008 | 8700 | 0.040 | 900 |
| | No. 17 | (Co0.83 | Fe0.05 | Ti0.02 Ru0.10)$_{79}$ | $Si_{15}B_6$ | 44000 | 0.007 | 8200 | 0.030 | 900 |
| Comparative | No. 18 | (Co0.71 | Fe0.04 | Ti0.15 Ru0.10)$_{75}$ | $Si_{17}B_8$ | 10000 | 0.020 | 4000 | 0.022 | 960 |
| Example 2 | No. 19 | (Co0.87 | Fe0.06 | Ti0.02 Ru0.05)$_{80}$ | $Si_{12}B_8$ | 5000 | 0.090 | 8400 | 0.100 | 900 |
| | No. 20 | (Co0.94 | Fe0.06)$_{75}$ | | $Si_{10}B_{15}$ | 10000 | 0.025 | 8000 | 7.0 | 870 |

From the above results, it can be observed that the abrasion-resistance, as well as the effective permeability, of the amorphous alloys incorporated with TM has been further improved by its synergistic action with Ru.

EXAMPLE 3

Following the procedures in Example 1, three kinds of thin ribbons of amorphous alloys were prepared having composition of $(Co_{0.83}Fe_{0.05}Ti_{0.02}Ru_{0.10})_{79}Si_{13}B_8$ each and being 30 μm, 20 μm and 14 μm thick, respectively, to measure the thickness dependence of the materials in the frequency characteristics of the effective permeability. The measurements were performed in the same manner as in Example 1.

Results of the measurements are graphed in the drawing (FIG. 1). As is seen therefrom, the materials of less thickness better satisfy the magnetic properties as a magnetic head for a video tape recorder.

As described in the foregoing, it is possible according to this invention to obtain, by adding Ru, an amorphous alloy for a magnetic head which is excellent in abrasion-resistance and simultaneously has high permeability, and further to obtain the alloy of more improved characteristics by adding both Ru and TM.

I claim:

1. An amorphous alloy for a magnetic head, which is of the formula:

$$(Co_{1-a-b-c}Fe_aRu_bTM_c)_{100-x-y}Si_xB_y$$

wherein TM is at least one selected from the group consisting of titanium(Ti), vanadium(V), chromium(Cr), manganese(Mn), nickel(Ni), zirconium(Zr), niobium(Nb), molybdenum(Mo), hafnium(Hf), tantalum(Ta) and tungsten(W), "a", "b", "c", "x" and "y" are atomic concentrations ranging from 0.02 to 0.08, 0.07 to 0.2, 0 or 0.01 to 0.1, 0 to 20, and 4 to 9, respectively.

2. The amorphous alloy according to claim 1, wherein said "c" is 0.

3. The amorphous alloy according to claim 1, wherein said "c" for TM ranges from 0.01 to 0.1.

4. The amorphous alloy according to claim 3, wherein said TM is Ti.

5. The amorphous alloy according to claim 3, wherein said TM is V.

6. The amorphous alloy according to claim 3, wherein said TM is Cr.

7. The amorphous alloy according to claim 3, wherein said TM is Mn.

8. The amorphous alloy according to claim 3, wherein said TM is Ni.

9. The amorphous alloy according to claim 3, wherein said TM is Zr.

10. The amorphous alloy according to claim 3, wherein said TM is Nb.

11. The amorphous alloy according to claim 3, wherein said TM is Hf.

12. The amorphous alloy according to claim 3, wherein said TM is Mo.

13. The amorphous alloy according to claim 3, wherein said TM is Ta.

14. The amorphous alloy according to claim 3, wherein said TM is W.

* * * * *